US005346145A

United States Patent [19]

Kamiwano et al.

[11] Patent Number: 5,346,145

[45] Date of Patent: Sep. 13, 1994

[54] DISPERSING AND GRINDING APPARATUS

[75] Inventors: Mitsuo Kamiwano, Yokohama; Yoshitaka Inoue, Tokyo, both of Japan

[73] Assignee: Inoue Mfg., Inc., Japan

[21] Appl. No.: 989,189

[22] Filed: Dec. 11, 1992

[30] Foreign Application Priority Data

Dec. 13, 1991 [JP] Japan ..... 3-351223

[51] Int. Cl.[5] ..... B02C 17/16; B02C 17/18

[52] U.S. Cl. ..... 241/172; 241/174; 241/183

[58] Field of Search ..... 241/172, 180, 174, 181, 241/183

[56] References Cited

U.S. PATENT DOCUMENTS

| | | | |
|---|---|---|---|
| 3,202,364 | 8/1965 | Wieland | 241/172 |
| 4,174,074 | 11/1979 | Geiger | 241/46.11 |
| 4,620,673 | 11/1986 | Canepa et al. | 241/69 |
| 4,856,717 | 8/1989 | Kamiwano et al. | 241/65 |
| 4,919,347 | 4/1990 | Kamiwano et al. | 241/65 |

*Primary Examiner*—Mark Rosenbaum
*Assistant Examiner*—John M. Husar
*Attorney, Agent, or Firm*—Bruce L. Adams; Van C. Wilks

[57] ABSTRACT

An apparatus for dispersing and grinding a material by means of a grinding medium, such as balls or beads, comprises a grinding vessel, and a rotor rotatably disposed in the grinding vessel to define a narrow annular flow path between the rotor and the inner wall of the grinding vessel. On the outer peripheral surface of the rotor, a set of guiding protrusions is disposed for guiding, in the circumferential direction, the flow of a mixture of the grinding medium and material flowing within the annular flow path. Inside the rotor, an inside flow path extends in the axial direction and a backward screw is disposed for returning the grinding medium in the inside flow path to the upstream side of the grinding vessel. The grinding medium gathering at the downstream side of the grinding vessel efficiently enters the inside flow path through inflow conduits provided on the rotor, the grinding medium and is urged backwards toward the upstream side by the backward screw. The grinding medium exits the inside flow path and returns to the upstream side through outflow conduits. Thus, the dispersion efficiency is improved and the treatment time of the material is reduced.

12 Claims, 1 Drawing Sheet

DISPERSING AND GRINDING APPARATUS

BACKGROUND OF THE INVENTION

1. Field of the Invention

The present invention relates to a dispersing and grinding apparatus in which grinding medium particulates, such as balls or beads, are agitated together with a material to be ground to apply shearing forces to the material, thereby finely grinding the material and dispersing it in a liquid.

2. Background Information

Various apparatuses are known and used for dispersing a material by means of a grinding medium. One such apparatus that is widely used has disks or rods protruding on an agitating shaft disposed within a grinding vessel to induce flow of the grinding medium. Another such apparatus is an annular-type dispersing and grinding apparatus, wherein a cylinder is disposed within the grinding vessel, and a narrow annular flow path is defined between the cylinder and the inner wall of the grinding vessel, thereby inducing flow of the grinding medium within the annular flow path.

In the annular-type dispersing and grinding apparatus, the material to be ground is fed from an inlet into the grinding vessel by a feeding means, such as a pump, dispersed within the annular flow path, and then discharged through an outlet. The mixture of the material and grinding medium flows through the annular flow path, from the inlet side toward the outlet side, and since only the dispersed material is discharged, the grinding medium tends to gather near the outlet side. For this reason, the grinding medium becomes unevenly distributed throughout the grinding vessel, and thus the dispersion efficiency becomes poor.

In order to solve the problem of uneven distribution of the grinding medium in the conventional annular-type dispersing and grinding apparatus, the present inventors previously developed a dispersing and grinding apparatus in which a forward screw is provided on the outer surface of a cylindrical rotor for inducing the flow of the grinding medium from the inlet side to the outlet side, and a backward screw is provided on the inner wall surface of the rotor for inducing the flow of the grinding medium from the outlet side back to the inlet side. This type apparatus is described, for example, in U.S. Pat. No. 4,856,717. In this apparatus, the grinding medium continually circulates through the outside and the inside of the rotor, thereby reducing the uneven distribution of the grinding medium.

The present inventors also previously developed a dispersing and grinding apparatus in which a guiding means is formed on the outer peripheral surface of the rotor for guiding the flow of the mixture of the material and grinding medium in the circumferential direction. One such apparatus is described in U.S. Pat. No. 4,919,347. In this apparatus, the flow of the mixture approximates that of a plug flow within the grinding vessel, and the mixture receives sufficient dispersion treatment during its flow from the inlet side to the outlet side.

These dispersing and grinding apparatuses previously proposed by the present inventors can attain good dispersion efficiencies. However, notwithstanding the improved dispersion efficiency of the apparatus disclosed in U.S. Pat. No. 4,919,347, there is still a tendency for the grinding medium to gather near the outlet side. Further, in the dispersing and grinding apparatus as disclosed in U.S. Pat. No. 4,856,717, the uneven distribution of the medium can be markedly reduced, but the movement of the medium is slow as compared with the apparatus indicated in U.S. Pat. No. 4,919,347, so that the treatment time is sometimes very long depending on the composition of the material. In addition, in the annular-type dispersing and grinding apparatus, the grinding medium moves around the rotor, so that if the return inlet for the grinding medium is located at the center portion of the rotor, the grinding medium enters the inlet inefficiently and with great difficulty.

SUMMARY OF THE INVENTION

It is an object of the present invention to solve the above-stated drawbacks associated with the prior art.

It is another object of the present invention to provide a dispersing and grinding apparatus wherein the material to be ground flows through an annular flow path of a grinding vessel from the inlet side toward the outlet side in a substantially plug flow style and wherein the grinding medium is evenly distributed.

It is another object of the present invention to provide a dispersing and grinding apparatus wherein the grinding medium enters into the inside of the rotor from the annular flow path simply and efficiently.

The present invention accomplishes these and other objects by providing a dispersing and grinding apparatus comprising a cylindrical rotor disposed within a grinding vessel, a narrow annular flow path defined between the outer peripheral surface of the rotor and the inner peripheral wall of the grinding vessel, a guiding means disposed on the outer peripheral surface of the rotor and/or the inner peripheral wall of the grinding vessel for guiding the flow of the mixture of the material and grinding medium in the circumferential direction, an inside flow path extending in the axial direction of the rotor at the center portion thereof, and a backward screw disposed within the inside flow path for returning the grinding medium from the outlet side toward the inlet side of the grinding vessel.

These and other objects and features of the present invention will become apparent to persons of ordinary skill in the art upon a reading of the following description of the present invention with reference to the accompanying drawings.

DETAILED DESCRIPTION OF THE PREFERRED EMBODIMENTS

The present invention will now be explained with reference to the embodiments described below, wherein the invention is applied to a horizontal-type dispersing and grinding apparatus. It should be noted, however, that the present invention can also be applied to a vertical-type dispersing and grinding apparatus wherein a grinding vessel is vertically disposed.

Figure 1:
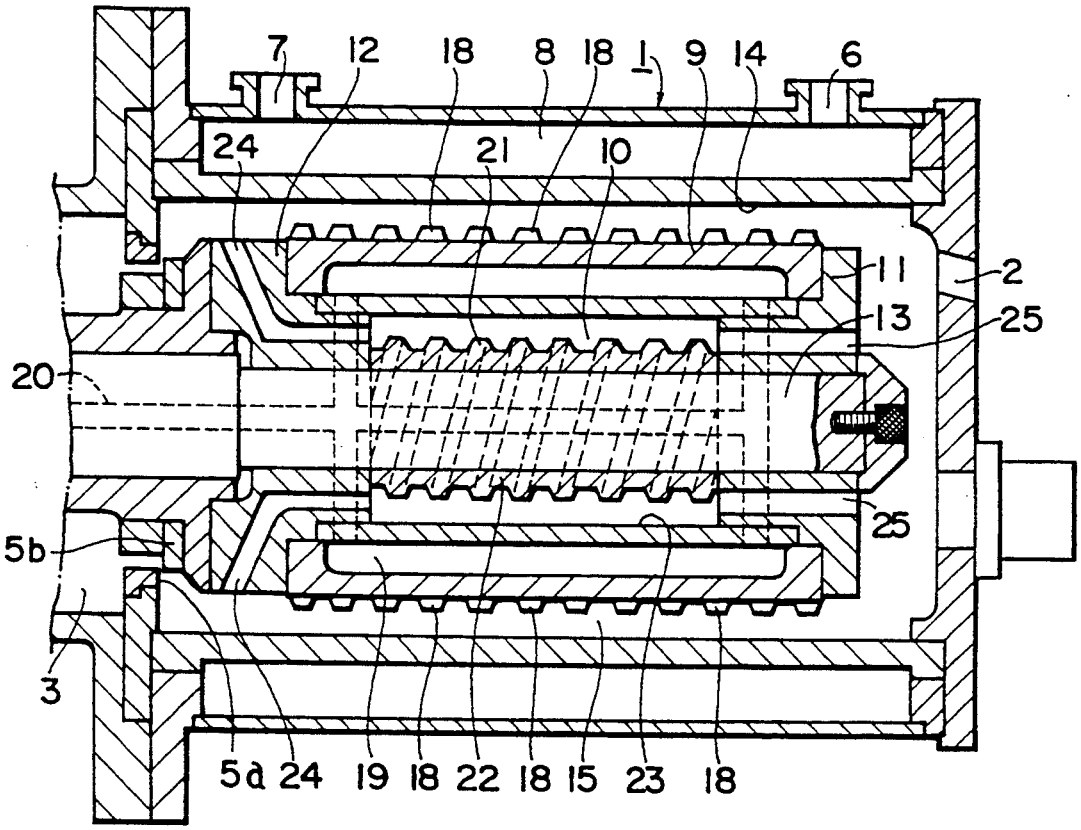
FIG. 1 is a vertical sectional view showing an embodiment of a dispersing and grinding apparatus according to the present invention.

FIG. 1 shows a vertical cross-sectional view of a dispersing and grinding apparatus according to the present invention. A grinding vessel 1 has an inlet 2 for introducing a material at the upstream end of the vessel and an outlet 3 for discharging the dispersed and ground material at the downstream end thereof. At the outlet side of the grinding vessel 1, separating means is provided for separating a grinding medium 4 from the processed material. In this embodiment, the separating means comprises a gap-type separator having a stator 5*a* and a rotor 5*b*, but a screen-type or other separator may also be used. An annular heat-exchange jacket 8 having an inflow port 6 and an outflow port 7 is disposed around the exterior of the grinding vessel 1 for circulating a temperature-controlling medium such as a cooling medium or a heating medium, e.g., water.

Inside the grinding vessel 1, rotor means such as a cylindrical rotor 9 is disposed along the axis of the grinding vessel 1. The rotor 9 has an inside flow path 10 extending in the axial direction, and the rotor 9 is fixed to a shaft 13 by end plates 11,12 disposed at both ends of the shaft 13. The rotor 9 is rotationally driven by rotating the shaft 13 using a suitable actuating means (not shown).

Between the outer peripheral surface of the rotor 9 and an inner peripheral wall 14 of the grinding vessel 1, a narrow annular flow path 15 is defined for flowing the mixture of the material and grinding medium. The radial dimension or width of the annular flow path is set such that rotation of the rotor 9 positively induces the flow of the grinding medium 4 which is in contact with the outer peripheral surface of the rotor 9, thereby positively assisting the flow of the mixture of the material and grinding medium in the circumferential direction around the narrow annular flow path 15 and helping disperse and grind the material. Specifically, the width of the annular flow path 15 should be at least 3 times, and preferably 4 times, the diameter of the grinding medium particulates.

On the outer peripheral surface of the rotor 9, guiding means 18 is provided for guiding the flow of the mixture from the inlet 2 to the outlet 3 of the grinding vessel 1 within the annular flow path 15 in the circumferential direction. The guiding means may instead be provided on the inner peripheral wall 14 of the grinding vessel 1, or may be provided on both the rotor outer surface and the vessel inner wall.

Figure 2:
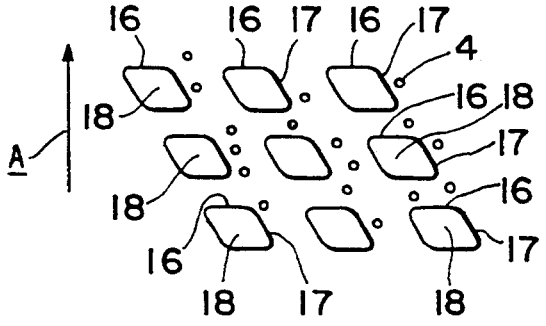
FIG. 2 is an explanatory view showing one embodiment of guiding means in accordance with the present invention.
Figure 3:
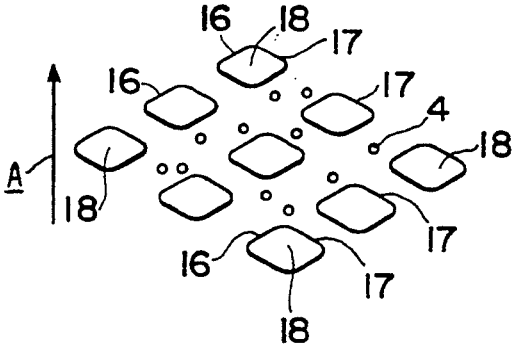
FIG. 3 is an explanatory view showing another embodiment of guiding means according to the present invention.

The configuration of the guiding means 18 may be selected from various shapes, including diamond, oval, circular, square and the like. The guiding means shown in FIG. 2 comprises a plurality of guide protrusions 18 disposed on the outer peripheral surface of the rotor 9. In this embodiment, the protrusions each have a diamond shape in the general configuration of a parallelogram having two pairs of opposed, parallel side surfaces. The four side surfaces include a forward guide surface 16 which faces in the rotational direction A of the rotor 9 for urging the mixture forwardly and guiding the mixture in the rotational direction, and a rearward guide surface 17 which faces toward the inlet 2 of the grinding vessel 1 for urging the mixture rearwardly. In FIG. 2, the forward guide surfaces 16 extend in the axial direction of the rotor 9 while the rearward guide surfaces 17 are inclined with respect to the rotor axis. Alternatively, each guide surface of the protrusions may be inclined with respect to the axial direction of the rotor 9 as shown in FIG. 3.

In the preferred embodiment, the protrusions are integrally formed as one body with the outer peripheral surface of the rotor 9, but the protrusions may also be formed as a bead padding by welding, or separately formed so that they may be implanted along the outer peripheral surface of the rotor. The guide protrusions may be made of a metal material having good abrasion resistance, or may be made of ceramics, engineering plastics, etc. The rotor 9 may be made entirely of a metal material having good abrasion resistance, or of ceramics or engineering plastics. The guide means may take the form of concavities rather than protrusions.

Inside the rotor 9, an annular jacket 19 is disposed for circulating a temperature-controlling medium, such as a cooling or heating medium, e.g., water, to regulate the temperature of the material during processing thereof within the grinding vessel 1. The annular jacket 19 communicates at opposite ends with a flow path 20 which extends through the shaft 13 for circulating the temperature-controlling medium through the jacket.

The apparatus is equipped with means for returning the grinding medium from the downstream end to the upstream end of the vessel 1 for re-use within the vessel. As shown in FIG. 1, such means comprises a return flow path 10 extending lengthwise inside of the rotor 9, and means for conveying the grinding medium particulates 4 through the return flow path to the upstream end of the vessel 1. In this embodiment, the conveying means comprises a backward screw 21 formed on the outer peripheral surface of a cylindrical screw body 22 which is fitted to the shaft 13 for rotation therewith. The backward screw 21 may also be formed on an inner peripheral wall 23 of the rotor 9.

In a portion of the inside flow path 10 located adjacent to the downstream end thereof, an aperture is provided so that the grinding medium 4 that gathers and accumulates in the annular flow path 15 near the outlet side may easily and efficiently enter the return flow path 10. In FIG. 1, plural inflow conduits 24 communicate the downstream end of the annular flow path 15 with the inside flow path 10, and the inflow conduits 24 terminate in apertures at the outer peripheral surface of the end plate 12 fitted to the rotor 9 so that the grinding medium 4 enters the inside flow path 10 through the inflow conduits 24. Alternatively, the inflow conduits may be formed directly in the rotor 9 itself. Outflow conduits 25 communicate the upstream end of the annular flow path 15 with the inside flow path 10, and the outflow conduits 25 terminate in apertures at the center portion of an end plate 11 fitted to the rotor 9 at the upstream side. These apertures may alternatively be located at other locations, such as the outer peripheral surface of the end plate 11 or the rotor 9 itself.

In operation, the material to be processed enters the grinding vessel 1 through the inlet 2 by an appropriate feeding means, such as a pump, etc., and advances through the annular flow path 15 together with the grinding medium 4 toward the outlet 3. The flow of the mixture of the material and grinding medium is guided by the guide protrusions 18 in the circumferential direction. The flow of the material through the flow path 15 approximates that of a plug flow, and the grinding medium particulates 4 are urged by the protrusions 18 in the rotational direction and sandwiched between the outer surface of the protrusions 18 and the inner peripheral wall 14 of the grinding vessel 1 to impart sufficient shearing forces to the material to uniformly grind and disperse the material into fine particles. This dispersion treatment is conducted substantially uniformly from the upstream end to the downstream end of the grinding vessel 1.

At the downstream end of the grinding vessel 1 in the region of the outlet 3, the separating means 5*a*, 5*b* separates the ground and dispersed material from the grinding medium 4 and the processed material is then discharged from the vessel 1 through the outlet 3. The grinding medium 4 that gathers near the outer peripheral surface of the rotor 9 at the outlet 3 enters the inflow conduits 24 of the inside flow path 10 and returns by means of the backward screw 21 through the outflow conduits 25 to the inlet 2 of the grinding vessel 1.

In the present invention as described above, the mixture of the material and grinding medium flows within the annular flow path 15 of the grinding vessel 1 in the circumferential direction, and the material is subjected to shearing forces by the movement of the grinding medium from the upstream end to the downstream end, whereby the material is finely dispersed. The annular flow path 15 is free from gathering of the grinding medium 4 at the outlet side of the grinding vessel 1 and from uneven distribution within the grinding vessel. The grinding medium 4 easily and efficiently enters the inflow conduits 24 at the downstream end of the grinding vessel, passes through the inside flow path 10, and returns to the upstream end through the outflow conduits 25 at the upstream end, whereby the material receives substantially uniform dispersion treatment from the inlet side to the outlet side, and thus the dispersion efficiency is improved. The easy and efficient entry of the grinding medium into the inside flow path via the inflow conduit apertures on the outer peripheral surface of the end plate 12 significantly speeds up the return movement of the grinding medium in contrast with the prior art, thereby reducing the treatment time of the material to be ground.

We claim:

1. A dispersing and grinding apparatus, comprising:

a grinding vessel having an upstream end, a downstream end, an inner peripheral wall between the upstream and downstream ends, an inlet at the upstream end for admitting a material to be processed into the grinding vessel and an outlet at the downstream end for discharging processed material from the grinding vessel;

a cylindrical rotor having an outer peripheral surface and being rotatably disposed within the grinding vessel, the rotor having an upstream end plate fitted at an upstream end of the rotor, a downstream end plate fitted at a downstream end of the rotor, and an inside flow path extending in the axial direction of the rotor and coacting with the grinding vessel to define an annular flow path between the outer peripheral surface of the rotor and the inner peripheral wall of the grinding vessel;

guiding means disposed within the annular flow path for guiding the flow of a mixture of the material and a grinding medium lengthwise through and circumferentially around the annular flow path from the inlet to the outlet when the rotor is rotated so that the grinding medium is moved slowly by the guiding means through the grinding vessel;

means for returning the grinding medium from the downstream end to the upstream end of the grinding vessel and including a backward screw disposed within the inside flow path for backwardly urging the grinding medium from the downstream end toward the upstream end;

inflow conduit means at the downstream end of the grinding vessel for leading the grinding medium from the annular flow path at the downstream end of the grinding vessel to the inside flow path, the inflow conduit means being formed in the downstream end plate and having an aperture on the outer peripheral surface of the downstream end plate; and outflow conduit means at the upstream end of the grinding vessel and communicating with the annular flow path for leading the grinding medium from the inside flow path back to the annular flow path at the upstream end for returning the grinding medium from the downstream end to the upstream end of the grinding vessel, the outflow conduit means being formed in the upstream end plate and having an aperture at the center portion of the upstream end plate.

2. A dispersing and grinding apparatus according to claim 1; wherein the guiding means comprises a plurality of protrusions having a parallelogram shape, the plurality of protrusions having a forward guide surface facing in the rotational direction of the rotor for urging the mixture of the material and grinding medium in the rotational direction, and a rearward guide surface facing toward the inlet of the grinding vessel for urging the mixture rearwardly toward the inlet.

3. A dispersing and grinding apparatus according to claim 1; wherein the backward screw is formed on the outer peripheral surface of a cylindrical screw body, and the screw body is fixed to a shaft extending through the central portion of the rotor.

4. A dispersing and grinding apparatus according to claim 1; wherein the guiding means is disposed on at least one of the outer peripheral surface of the rotor and the inner peripheral wall of the grinding vessel.

5. A dispersing and grinding apparatus, comprising:

a grinding vessel having inlet means at an upstream end of the grinding vessel for admitting material to be processed into the vessel and outlet means at a downstream end of the grinding vessel for discharging processed material from the vessel;

a rotor having a hollowed portion and being rotatably disposed within the grinding vessel to define an annular flow path between the rotor and the grinding vessel, the rotor being fixed to a shaft extending through the central portion of the rotor by end plates at both ends of the shaft;

guiding means disposed within the annular flow path for guiding flow of a mixture of the material and a grinding medium from the inlet means toward the outlet means while also guiding flow of the mixture in the rotational direction of the rotor so that the grinding medium is moved slowly by the guiding means through the grinding vessel;

reverse flow means for returning the grinding medium from the downstream end to the upstream end of the grinding vessel and being disposed within the hollowed portion of the rotor and including an inside flow path within the hollowed portion of the rotor from the upstream end to the downstream end for flowing the grinding medium from a location adjacent the outlet means through the inside flow path toward a location adjacent the inlet means;

inflow conduit means at the downstream end of the inside flow path for allowing grinding medium that accumulates at the location adjacent the outlet means to enter from the annular flow path to the inside flow path, the inflow conduit means having an aperture formed in the outer peripheral surface of the end plate fixed to the end of the shaft nearest the downstream end of the grinding vessel; and outflow conduit means at the upstream end of the inside flow path and communicating with the annular flow path for allowing the grinding medium to flow from the inside flow path back to the annular flow path at the upstream end for returning the grinding medium to the annular flow path.

6. A dispersing and grinding apparatus according to claim 5; wherein the grinding vessel has an inner peripheral wall and the rotor has an outer peripheral surface, and wherein the annular flow path is defined by the outer peripheral surface of the rotor and the inner peripheral wall of the grinding vessel.

7. A dispersing and grinding apparatus according to claim 6; wherein the guiding means is disposed on at least one of the outer peripheral surface of the rotor and the inner peripheral wall of the grinding vessel.

8. A dispersing and grinding apparatus according to claim 5; wherein the guiding means is disposed on at least one of a surface of the rotor and a wall of the grinding vessel.

9. A dispersing and grinding apparatus according to claim 5; wherein the guiding means comprises a plurality of protrusions, each protrusion having a forward guide surface facing in the rotational direction of the rotor for urging the mixture forwardly and guiding the mixture in the rotational direction, and a rearward guide surface facing toward the inlet means of the grinding vessel for urging the mixture rearwardly toward the inlet means.

10. A dispersing and grinding apparatus according to claim 9; wherein the shape of the protrusions is at least one of diamond, oval, circular, and square.

11. A dispersing and grinding apparatus according to claim 5, wherein the reverse flow means comprises a backward screw formed on the outer peripheral surface of a cylindrical body which is fixed to the shaft.

12. A dispersing and grinding apparatus according to claim 5, wherein the outflow conduit means has an aperture formed in the outer peripheral surface of the end plate fixed to the end of the shaft nearest the upstream end of the grinding vessel.

* * * * *